US005864888A

United States Patent [19]

Archer

[11] Patent Number: 5,864,888

[45] Date of Patent: Feb. 2, 1999

[54] REMOVABLE AND CONVERTIBLE SKI PANTS

[76] Inventor: Eric L. Archer, P.O. Box 983, Vail, Colo. 81658

[21] Appl. No.: 899,162

[22] Filed: Jul. 23, 1997

[51] Int. Cl.[6] ..... A41D 1/06

[52] U.S. Cl. ..... 2/227; 2/70

[58] Field of Search ..... 2/227, 70, 83, 2/919, 456, 22, 228, 242, 23

[56] References Cited

U.S. PATENT DOCUMENTS

| | | | |
|---|---|---|---|
| D. 261,324 | 10/1981 | Catron . | |
| 269,489 | 12/1882 | Stretch et al. . | |
| D. 333,203 | 2/1993 | Jones . | |
| D. 337,194 | 7/1993 | Marks . | |
| D. 341,693 | 11/1993 | Nichols et al. . | |
| D. 341,919 | 12/1993 | Grimes . | |
| 2,498,048 | 2/1950 | Neinken . | |
| 3,266,057 | 8/1966 | Phelps | 2/227 |
| 3,801,986 | 4/1974 | Purdon . | |
| 4,069,514 | 1/1978 | Palmeiri et al. . | |
| 4,117,609 | 10/1978 | Helt | 2/227 X |
| 4,190,908 | 3/1980 | Herskind | 2/227 X |
| 4,215,435 | 8/1980 | Miele . | |
| 4,580,298 | 4/1986 | Tuisl . | |
| 4,638,509 | 1/1987 | Charron . | |
| 4,766,613 | 8/1988 | Wells | 2/227 |
| 5,008,962 | 4/1991 | Smith et al. | 2/227 X |
| 5,084,914 | 2/1992 | Hesch | 2/227 X |
| 5,097,535 | 3/1992 | Dye et al. | 2/227 X |
| 5,153,944 | 10/1992 | Teel | 2/227 X |
| 5,182,812 | 2/1993 | Goldsby . | |
| 5,315,716 | 5/1994 | Baum . | |
| 5,608,915 | 3/1997 | Libit . | |

FOREIGN PATENT DOCUMENTS

| | | |
|---|---|---|
| 1176119 | 4/1959 | France . |
| 1363957 | 5/1964 | France . |
| 2449414 | 10/1980 | France . |
| 807926 | 4/1951 | Germany . |
| 1803765 | 5/1970 | Germany . |
| 454954 | 2/1950 | Italy . |
| 511414 | 8/1939 | United Kingdom . |
| 2027330 | 2/1980 | United Kingdom . |
| 1589300 | 5/1981 | United Kingdom . |
| 2271711 | 4/1994 | United Kingdom . |

*Primary Examiner*—Michael A. Neas
*Assistant Examiner*—Shirra L. Jenkins
*Attorney, Agent, or Firm*—Hunton & Williams

[57] ABSTRACT

Convertible skiing pants are disclosed. The skiing pants comprise an upper pants portion or shorts, which includes a waist opening and respective leg openings. The leg openings of the upper pants portions are located around the knees of the skier. A pair of lower pants portion may be removably attached to the upper pants portion by an attachment device, such as a zipper, which extends substantially circumferentially around the legs of the skier. The upper pants portion and both lower pants portions include a device for opening the respective portions along a longitudinal length thereof so that the ski pants may be converted to ski short and the shorts removed altogether, all without the need to remove skis or ski boots.

8 Claims, 9 Drawing Sheets

REMOVABLE AND CONVERTIBLE SKI PANTS

BACKGROUND OF THE INVENTION

1. Field of the Invention

This invention is directed to the field of recreational clothing, and more particularly to skiing pants which may be worn by skiers and converted to skiing shorts or alternatively removed altogether without having to remove skis, ski boots or other footwear.

2. Description of the Prior Art

Trousers which can be converted to shorts by the temporary removal of all or part of each leg are generally known in the art. Generally, the trousers are detachable along the mid-thigh by means of hook and loop, zippers, snaps or buttons. While such trousers may be easily converted to shorts, the wearer generally still must remove their shoes in order to remove the lower half of the garment which generally covers the area below the knees of the wearer.

UK patent application 2271711 discloses convertible trousers in which the lower half of the garment may be removed from the upper trouser portion to convert the trousers into shorts. The lower removable trouser portion which generally covers the portions of the legs below the knees is provided with a side opening allowing the lower half of the shorts to be opened along the length thereof. While the U.K. '711 Patent discloses convertible trousers in which the calf or lower leg portion may be removed while footwear is worn, the converted shorts of the U.K. '711 Patent cannot also be removed. While the wearer is outfitted with oversized apparatuses attached to the feet, such as skis.

Thus, prior art convertible garments are not directed to, nor solve, the unique problems specifically applicable to the recreational and competitive sporting industry. In particular, none of the prior art appears to be directed specifically to converting a pair of skiing pants to skiing shorts. Until now, no pants have been known to utilize removable fasteners to create a removable pant and a removable short together as a single unitary garment. Furthermore, no such combination of removable pants and removable shorts is known to have been proposed for a garment for use in the recreational and competitive sporting industry, and particularly for wear by downhill skiers.

These and other disadvantages of the prior art are sought to be overcome by the convertible skiing pants of the preferred embodiments.

SUMMARY OF THE INVENTION

It is an object of the present invention to provide convertible skiing pants which will allow quick and easy conversion of the pants to shorts without the necessity of the wearer removing either skis or ski boots.

It is a further object of the present invention to provide a pair of ski shorts which may be removed without the need for the removal of either the skis or the ski boots.

The invention of the preferred embodiment performs the dual function of a removably fastened pant and a removably fastened short together in one garment. The convertible garment permits downhill skiers to wear removably fastened shorts over racing suits while training in the much quicker discipline of the slalom. Advantageously, the removable ski shorts pose less restriction to movement of the legs, permit installation of protective gear on the lower legs, and allow the wearers to keep major muscle groups of the thighs and legs warm.

The invention of the preferred embodiments is farther directed to a system in which removable fasteners can be utilized to create pants that will enable the wearer to easily remove the first and second lower legs of the pants to create shorts, remove the pants altogether without the need to remove footwear, and remove the shorts easily without the need to remove footwear after the lower leg or pant portions have been removed.

More particularly, the invention of the preferred embodiment comprises an upper pants portion worn about the waist of the wear. The upper pants portion forms the ski shorts. The upper pants portion includes a waist opening and two leg openings. When the garment is worn, the leg openings preferably are located just above the knees of the wearer. Each lower leg opening includes a securing system comprising a zipper for releasable attachment with respective first and second lower pant portions. When worn, the lower pant portions extend from the leg opening to the ankle of the wearer. Both lower pant portions include a device extending along the longitudinal length thereof for removing, one at a time, each lower pant portion without having to remove footwear such as skis or ski boots. Then, once the ski pants have been converted to ski shorts, the upper pants portion may also be removed by a zipper extending along respective thigh segments from the leg openings to the waist opening to permit the shorts to be removed without having to remove footwear, such as skis or ski boots.

These and other objects, features and advantages of the invention will become apparent when the detailed description of the preferred embodiments is read in conjunction with the attached drawing figures.

DETAILED DESCRIPTION OF THE PREFERRED EMBODIMENT

With reference to the attached FIGS. 1–7, there is illustrated a first preferred embodiment of convertible skiing pants 10 which allow the pants to be converted to shorts 12 and the shorts to be removed altogether without removing any footwear 14, such as skis or ski boots. The convertible skiing pants 10 include an upper pants portion or shorts 12.

Figure 6:
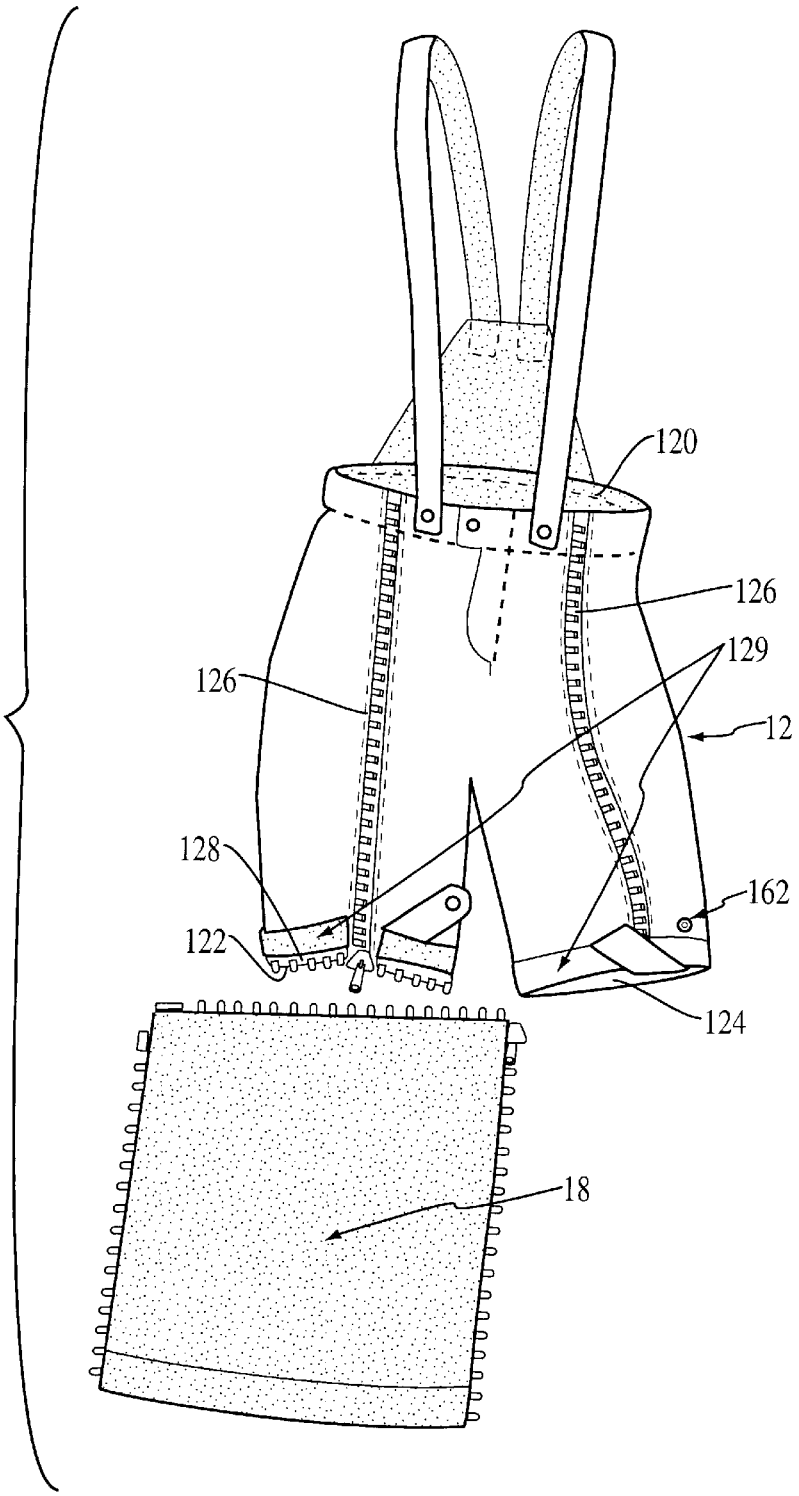
FIG. 6 is a schematic diagram of the ski pants in accordance with the first preferred embodiment in which the lower halves of the pants have been removed.
Figure 7:
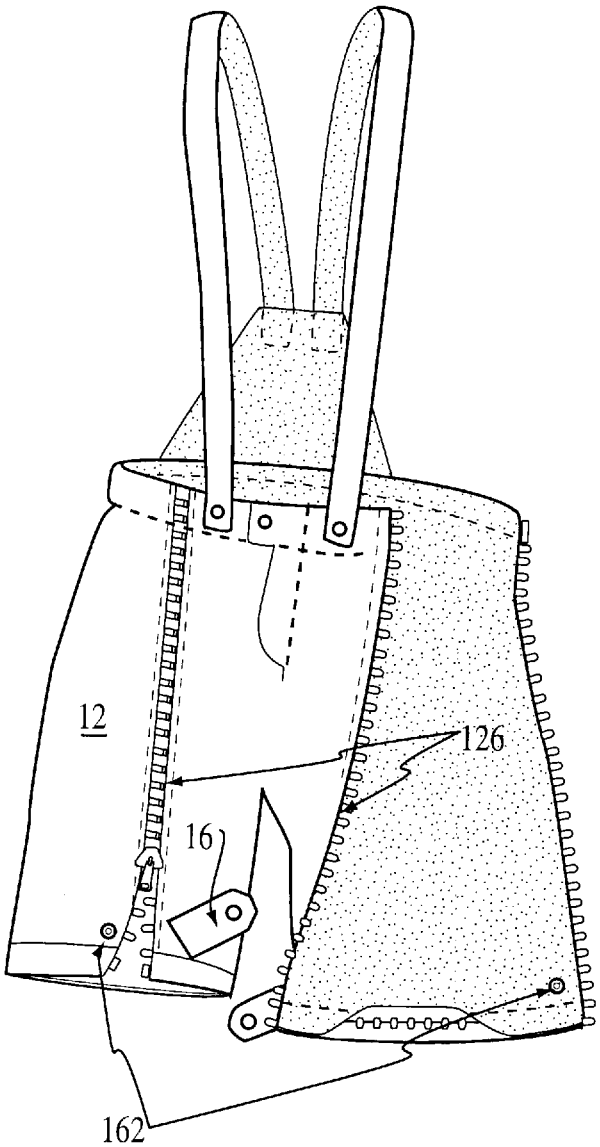
FIG. 7 is a schematic illustration of the ski pants in accordance with the first preferred embodiment in which the lower halves have been removed and the shorts opened along the longitudinal length for removal from the wearer.

As best seen in FIG. 6, the upper pants portion 12 includes a waist opening 120 and two leg openings 122, 124. When the upper pants portion 12 is worn, the leg openings 122, 124 preferably are positioned just above the knees of the wearer. The upper pants portion 12 is particularly adapted for keeping the thighs of the skier warm during and following warm-up runs.

The upper pants portion 12 further includes a first device 126 for opening and removing the shorts without having to remove footwear. The opening device 126 also serves to secure the shorts about the upper thighs of the skier. The opening device 126 preferably extends from respective leg openings 122, 124 to the waist opening 120. The opening device 126 preferably comprises a zipper, but could optionally comprise snaps, buttons, hook and loop material or any other material which facilitates quick access to the interior of the garment.

The upper pants portion 12 further includes a first attachment device 128 for removable attachment with the corresponding first and second lower pants portion 18. The device 128 for removable attachment of lower pants portion 18 is preferably a zipper. Alternatively, other devices for effecting removable attachment of the lower pants portion 18 from the upper pants portion 12 are contemplated. For example, instead of zipper, the attachment device may comprise snaps, buttons, hook and loop material, to name just a few. In the most preferred embodiment, the zipper 128 extends substantially completely around the respective leg openings 122, 124 of the upper pants portion in a circumferential manner.

Figure 5:
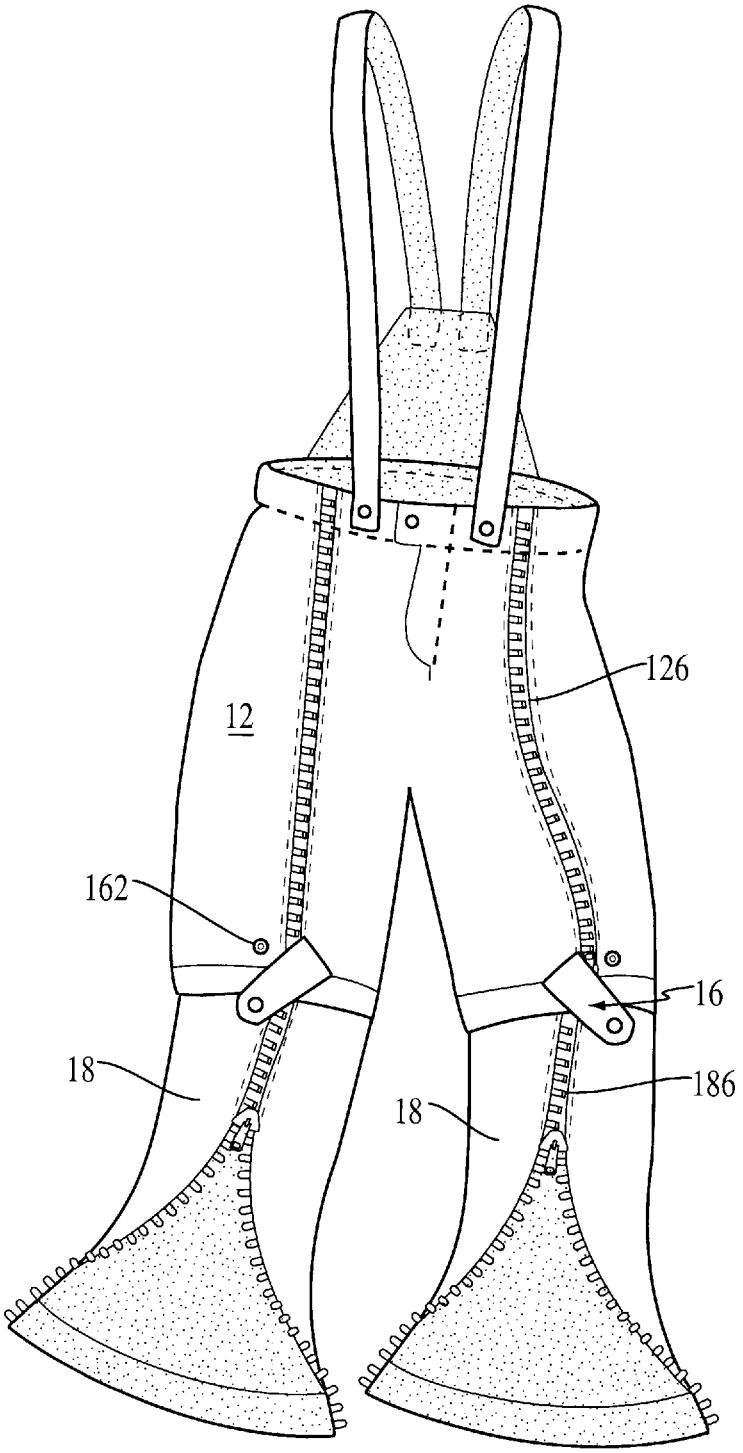
FIG. 5 is a schematic diagram of the ski pants according to the preferred embodiment showing the lower half partially detached from the upper half of the pant, as well as the lower halves in a partially opened condition.
Figure 5A:
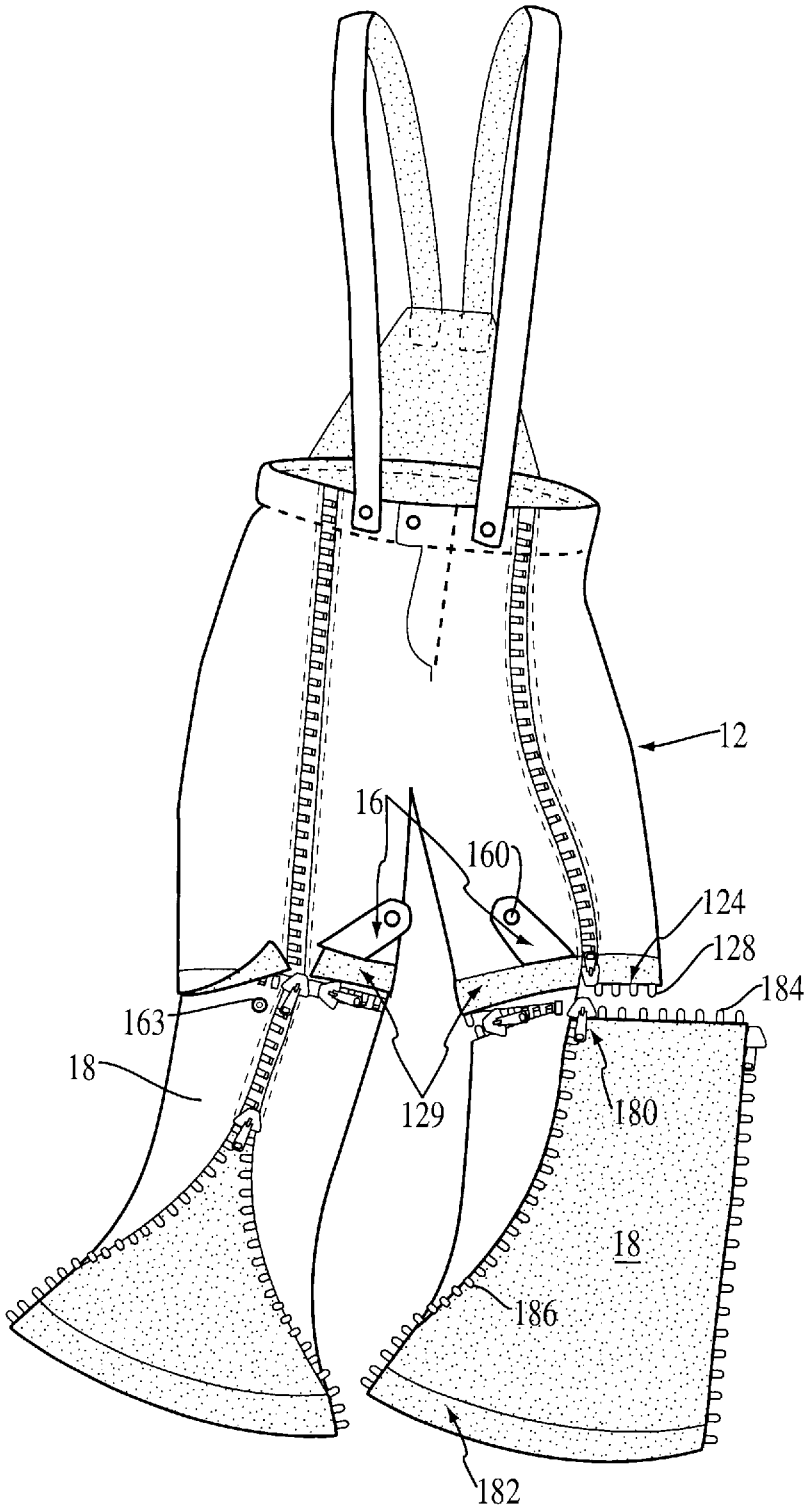

The convertible skiing pants further include a pair of lower pant portions 18. The lower pant portions 18 are substantially identical to one another, so only one will be described. With particular reference to FIG. 5, the lower pant portions 18 include an upper leg opening 180 and a lower leg opening 182. The upper leg opening 180 may be removably attached to the leg opening 124 of the upper pants portion 12. As explained, the upper leg opening 180 preferably includes a second attachment device 184, such as a zipper, to effect the removable attachment with leg opening 124 of the upper pants portion 12. The combination of the first and second removable attachment devices 128, 184 attaching the lower pant portion 18 with the upper pants portion 12 forms a substantially circumferential securing device preferably located just above the knee of the skier. Alternatively, the attachment device 184 for facilitating removable of the lower pant portion 18 may be a snap, button or hook and loop material.

As in the upper pants portion 12, the lower pant portion 18 includes a second device 186 for opening and removing the lower pant portion 18 without having to remove footwear. The opening device 186 also serves to secure the lower pant portion 18 around the calves or first and second lower legs of the skier. The opening device 186 preferably extends from lower leg opening 182 to the upper leg opening 124. The opening device 186 preferably comprises a zipper, but could optionally comprise snaps, buttons, hook and loop material or any other material which facilitates quick access to the interior of the garment.

Figure 3:
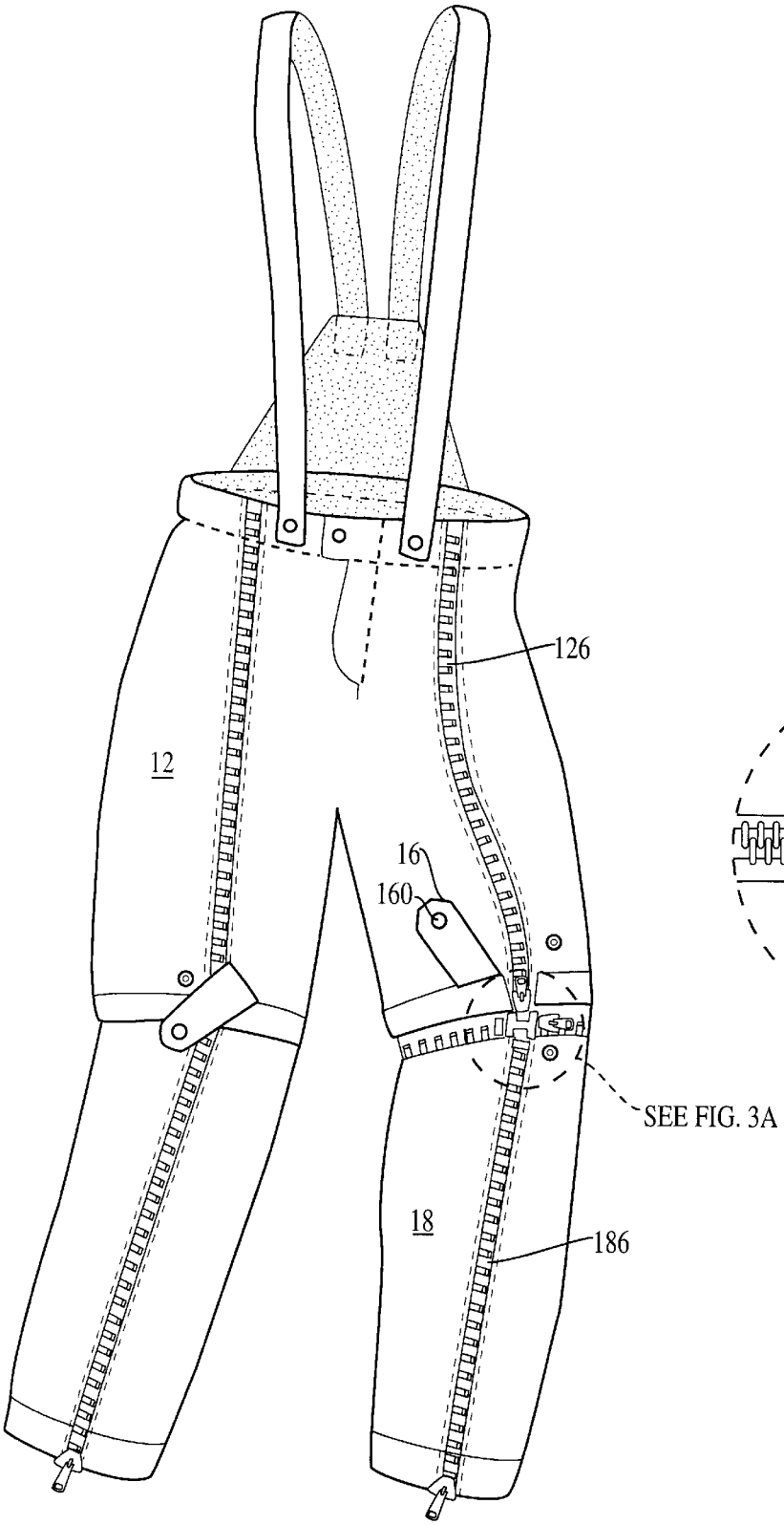
FIG. 3 is a schematic close-up of the convertible ski pants illustrating the method of attaching the lower halves of the ski pants with the upper shorts as well as illustrating the device for opening the ski pants along their longitudinal length.
Figure 3A:
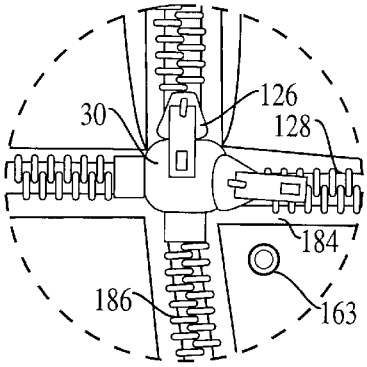
Figure 4:
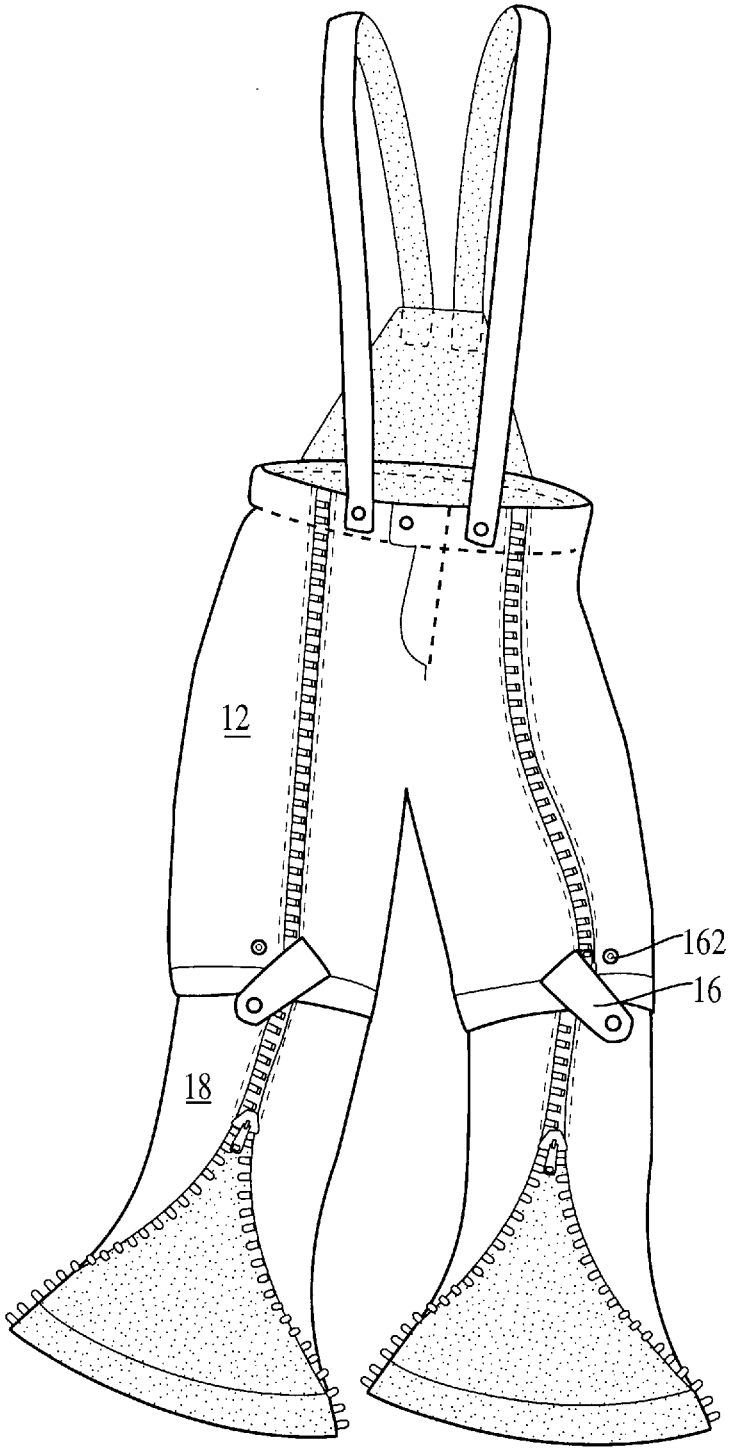
FIG. 4 is a schematic illustration of the ski pants according to their preferred embodiment shown partially open.
Figure 4A:
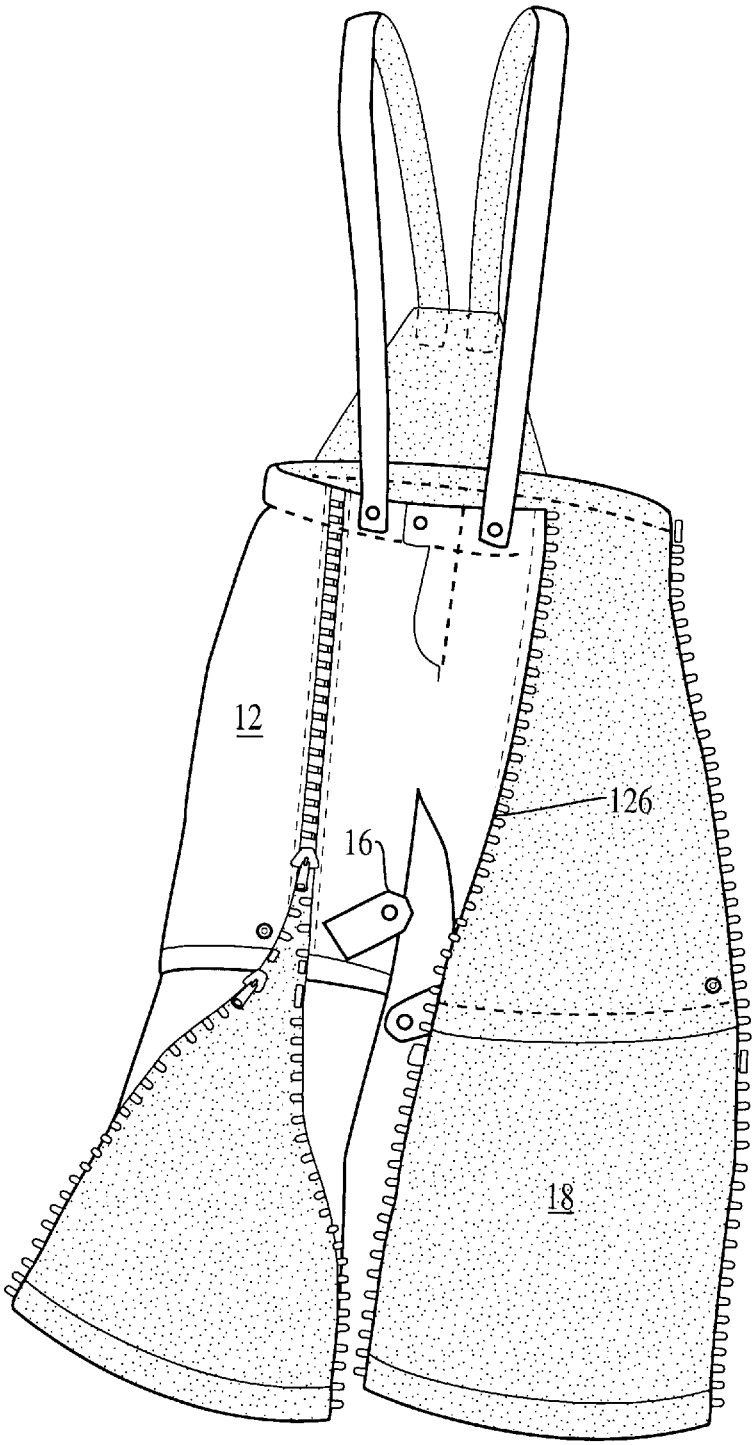

The convertible skiing pants 10 further includes first and second flaps 16 attached to the upper pants portion 12 just above the leg openings. The flap 16 includes a female snap member 160 on the end thereof. Both lower leg portions 18 preferably include corresponding male snap members 163 positioned just below the upper leg opening 180. As best seen in FIGS. 3 and 3A, flap 16 preferably extends diagonally across the intersection of the upper 126 and lower 186 longitudinal zippers and circumferential zippers 128, 184. Flap 16 further secures the lower pants portions 18 to the upper pants portion 12, as well as covers the small opening 30 (FIG. 3) where the zippers come together to prevent wind and snow from entering the small opening 30, particularly in the event of a fall.

The longitudinally extending zippers 126, 186 are preferably positioned along the front of and centered on the thighs and lower leg portions of the convertible pants. This placement of the zippers 126, 186 is particularly advantageous for skiers who train in the slalom and giant slalom. As skiers and those of ordinary skill in the art will readily appreciate, a skier in the slalom discipline negotiates a number of gates while working the hill. Sometimes when doing so, the sides of the skiers' legs contact the gates. By having the zippers 126, 186 positioned along the front of and centered on the thighs and lower leg portions of the convertible pants, the likelihood of the zippers contacting, grabbing or damaging the gates or causing injury to the skier is greatly reduced if not substantially eliminated.

Figure 1:
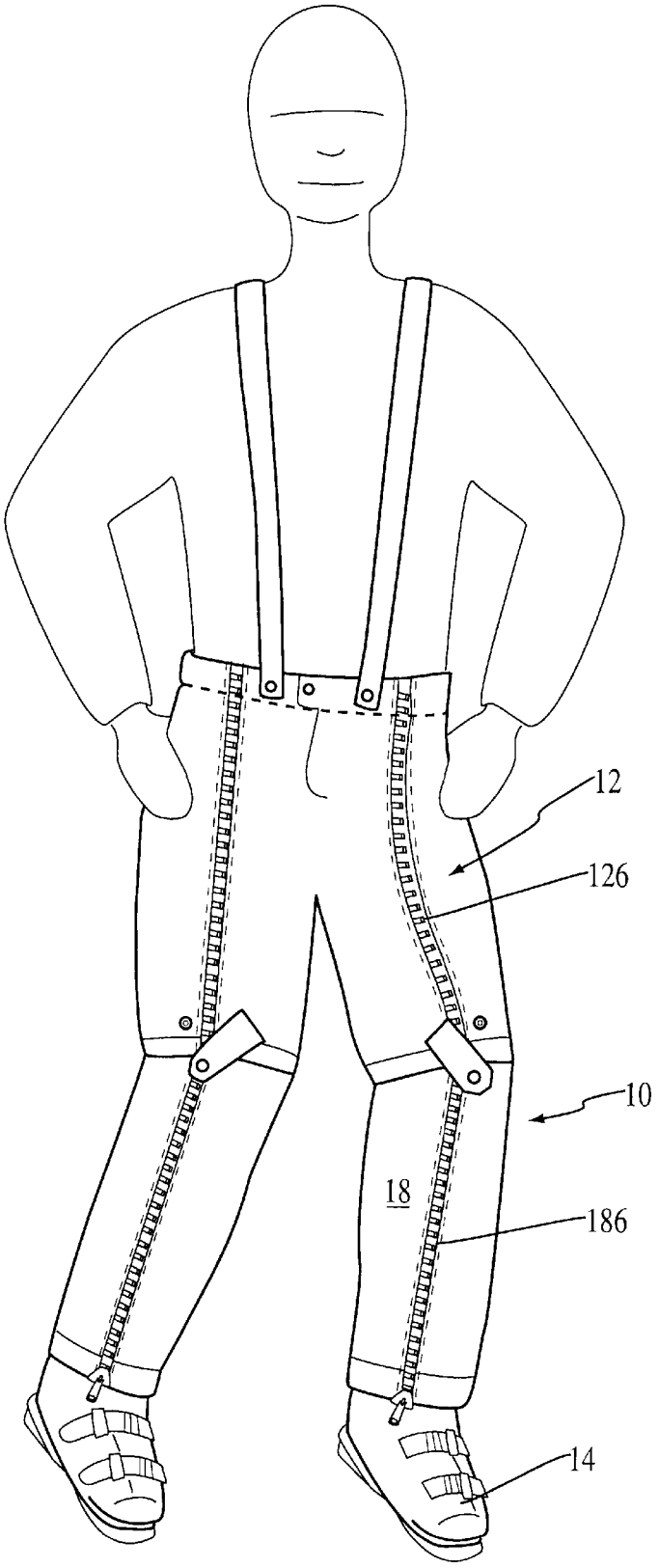
FIG. 1 is a schematic view of a skier wearing the convertible ski pants of the preferred embodiment.
Figure 2:
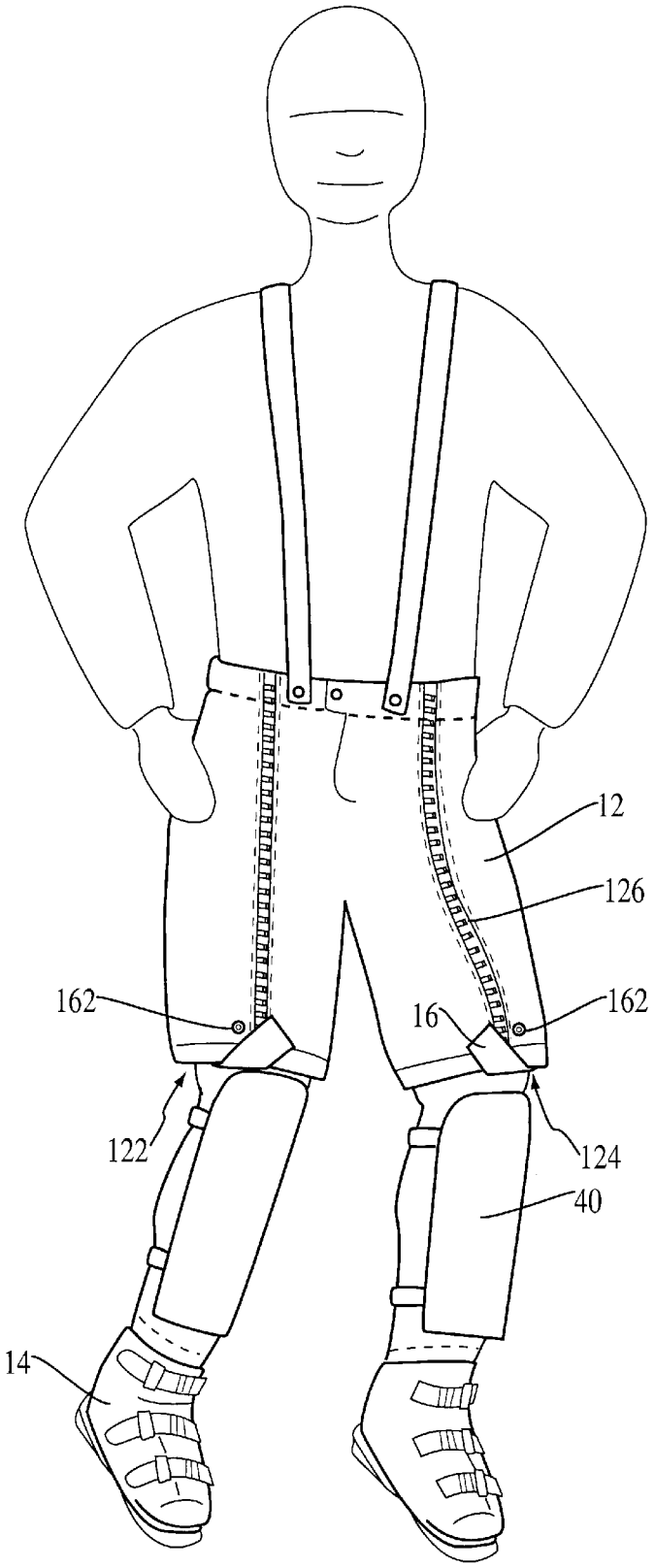
FIG. 2 is a schematic diagram of a skier wearing the convertible ski pants of FIG. 1 with the lower halves of the pants removed.

As best seen in FIG. 2, after the lower pants portion 18 have been removed from upper pants portion 12, thereby converting the convertible ski pants into ski shorts, additional accessories such as shin guards 40 may be worn on the lower leg portions of the wearer. In addition, as seen in FIG. 2, after lower pant portion 18 is removed from upper pant portion 12, flap 16 may be folded under and inserted into leg opening 124 for engagement with and securement to snap 162. Furthermore, as best seen in FIG. 6, upper pant portion 12 may further include a hem 129 which is attached to the portion of upper pant portion 12 just above leg openings 122, 124 atop zipper 128. Hem 129 may be raised as shown in FIG. 6 to facilitate the removal of lower pant portion 18, following which hem 129 may then be lowered to cover the exposed zipper 128 for a more pleasing appearance.

The convertible ski pants according to the preferred embodiments may be manufactured from any number of materials known in the art, including, but not limited to a nylon, lycra or polyester outer covering, and a nonwoven inner liner. In addition, the convertible ski pants may further include suitable insulating material 4 designed to keep the skier warm, without adding significant bulk or weight to the pants.

The invention has been described in connection with the preferred embodiment. However, the invention is not limited thereto. Rather, as will be appreciated by those of skill in the art that various modifications may be made to the preferred embodiment without departing from the spirit and scope of the invention as defined by the appended claims.

I claim:

1. Convertible ski pants worn by a skier comprising:

an upper pants portion adapted to be worn about the waist and upper legs of the wearer, said upper pants portion comprising a waist hole and two leg holes;

a first lower pant portion adapted to be worn about a first lower leg of the wearer;

a second lower pant portion adapted to be worn about a second lower leg of the wearer;

first attachment means associated with each of said two leg holes of said upper pants portion;

second attachment means associated with each of said first and second lower pant portions, said first attachment means respectively cooperating with said second attachment means to form a pair of unitary ski pants, said first and second attachment means permitting selective detachment of said first and second lower pant portions from said upper pants portion in order to convert said skiing pants into skiing shorts;

first means associated with each of said first and second lower pants portions for opening and closing said first and second lower pants portion to facilitate removal and installation thereof; and second means associated with each upper leg portion of said upper pants portion for opening and closing each of said upper leg portions; wherein said first opening means and said second opening means are positioned to correspond approximately with the front of the legs of the wearer and permit said ski pants to be converted to ski shorts and said ski shorts to be removed and vice versa without removing skis or ski boots; and a first flap, located on the right side of the pants, having one end releasably attached to one of said upper or lower pants portion and the other end secured to the other of said upper or lower pants portion; and a second flap, located on the left side of the pants, having one end releasably attached to one of said upper or lower pants portion and the other end secured to the other of said upper or lower pants portion.

2. The convertible skiing pants of claim 1, said first opening means comprising a zipper extending along said first and second lower pants portion.

3. The convertible skiing pants of claim 1, said second opening means comprising a zipper extending along each of said upper leg portions.

4. The convertible skiing pants of claim 1, said first and second attachment means joined above the knee of the wearer.

5. The convertible skiing pants of claim 1, further comprising means for insulating the skiing pants against heat loss.

6. The convertible skiing pants of claim 1, said first opening means extending substantially entirely along respective said first and second lower pant portions.

7. The convertible skiing pants of claim 1, said second opening means extending substantially entirely from respective said leg holes to said waist.

8. A removable, convertible skiing accessory comprising:

ski shorts comprising a waist opening and a pair of leg openings;

a pair of lower pants portions respectively corresponding to said pair of leg openings and adapted to be attached to said ski shorts to convert said ski shorts into ski pants;

first attachment means associated with said pair of leg openings of said ski shorts;

second attachment means associated with said pair of lower pants portions, said first attachment means respectively cooperating with said second attachment means to form a pair of unitary ski pants, said first and second attachment means permitting selective detachment of said first and second lower pants portions from said upper pants portion in order to convert said ski shorts into ski pants; and opening means associated with said ski shorts and said pair of lower pants portions, said opening means allowing said ski shorts and said ski pants to be removed and installed without having to remove skis or ski boots; and a first flap, located on the right side of the accessory, having one end releasably attached to one of said ski shorts or lower pants portion and the other end secured to the other of said ski shorts or lower pants portion; and a second flap, located on the left side of the accessory, having one end releasably attached to one of said ski shorts or lower pants portion and the other end secured to the other of said ski shorts or lower pants portion.

* * * * *